United States Patent [19]

Torres

[11] 4,437,422

[45] Mar. 20, 1984

[54] STOP CONTROL MECHANISM FOR FEEDING A MATERIAL TO A WORK PERFORMING MACHINE

[76] Inventor: Julio B. Torres, 981 Arapahoe St., Los Angeles, Calif. 90006

[21] Appl. No.: 350,979

[22] Filed: Feb. 22, 1982

[51] Int. Cl.[3] ..... B65H 63/02; B65H 63/06; B65H 25/00; D05B 69/36

[52] U.S. Cl. ..... 112/272; 112/273; 112/277; 139/370.1; 200/61.18; 200/61.13

[58] Field of Search ..... 112/273, 278, 272, 275, 112/277; 139/370.1, 370.2; 66/163; 200/61.13, 61.18, 61.41, 61.42, 6 R

[56] References Cited

U.S. PATENT DOCUMENTS

| | | | |
|---|---|---|---|
| 1,499,868 | 7/1924 | Mills et al. | 112/273 |
| 2,639,735 | 5/1953 | Fisher | 139/370.1 |
| 3,301,974 | 1/1967 | Hancock | 200/61.13 |
| 4,111,565 | 9/1978 | Jagger | 200/61.18 |
| 4,306,231 | 12/1981 | Bagnall et al. | 112/278 |

FOREIGN PATENT DOCUMENTS

| | | | |
|---|---|---|---|
| 48001 | 1/1980 | U.S.S.R. | 139/370.2 |

*Primary Examiner*—Werner H. Schroeder
*Assistant Examiner*—Steven N. Meyers
*Attorney, Agent, or Firm*—Whann & McManigal

[57] ABSTRACT

A stop control for a sewing machine having an attachment for the making of spaghetti-like tubes, without visible stitching, and with or without a core filler, from a supplied bias binding material, the binding material being comprised of elongate strips joined in end-to-end relation by end connecting seams in which the connected free ends of the strips are disposed on the same side. The strip is fed to the attachment through a switching device in an electric control circuit which is energizable by contacts of the switching device and operable to terminate the operation of the sewing machine upon the occurance of a predetermined condition with respect to the binding strip material, such as: (1) a binding strip connecting end seam is too thick, (2) the binding strip becomes knotted or twisted, and, (3) the supplied binding strip material breaks or runs out.

7 Claims, 7 Drawing Figures

FIG. 1.
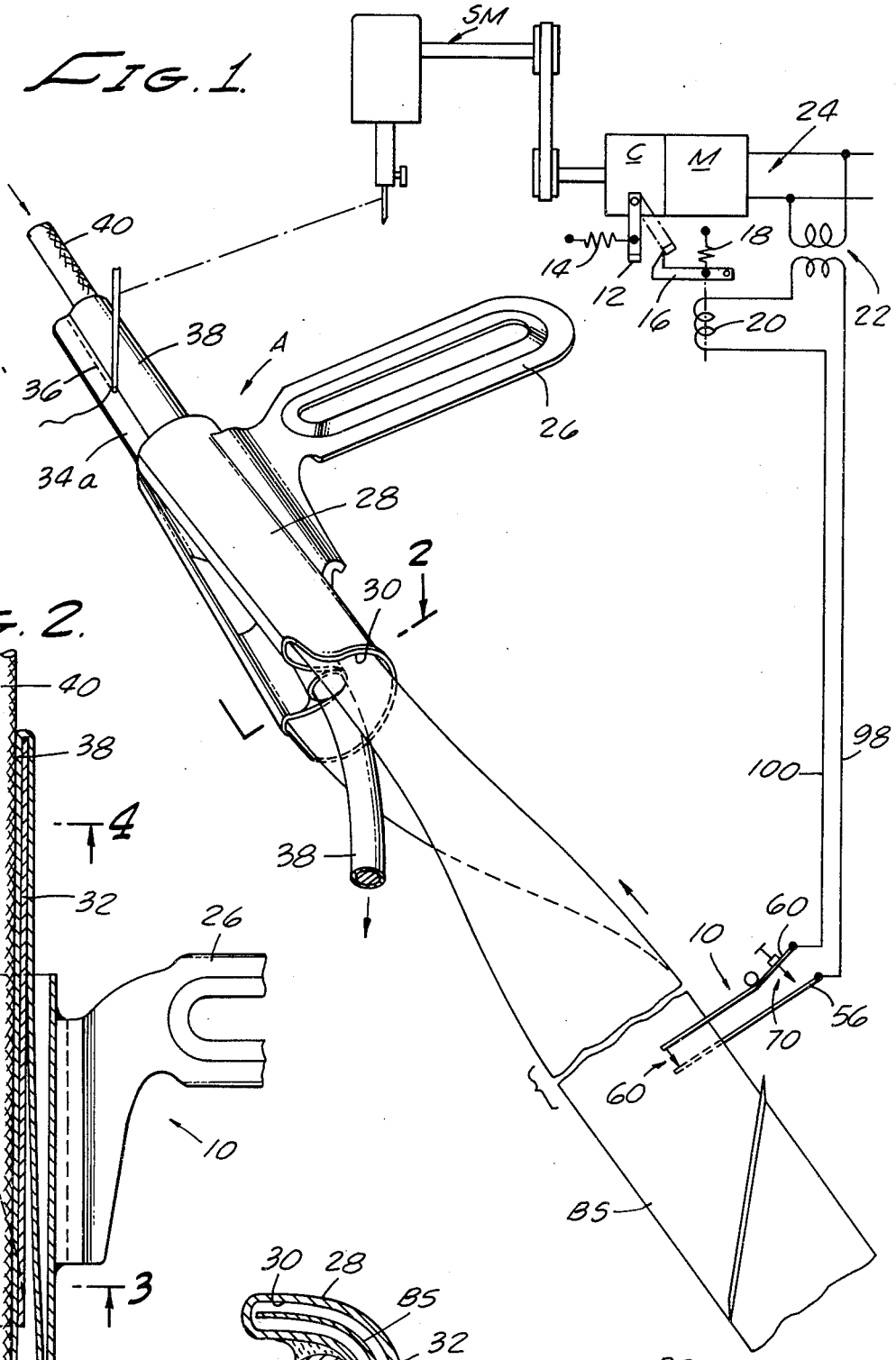
FIG. 2.
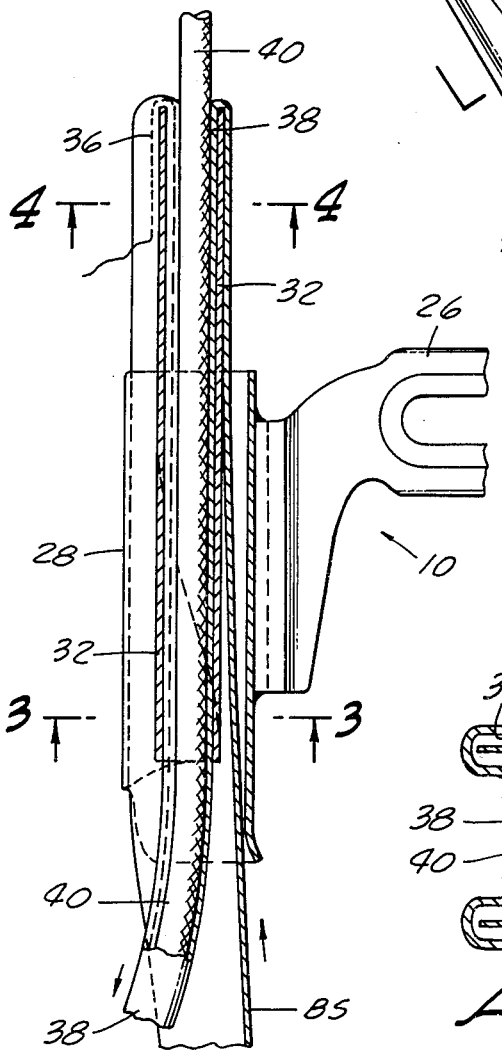
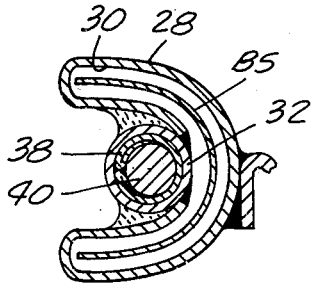
FIG. 3.
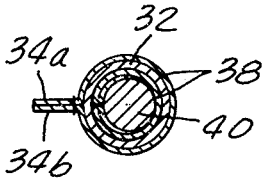
FIG. 4.

STOP CONTROL MECHANISM FOR FEEDING A MATERIAL TO A WORK PERFORMING MACHINE

BACKGROUND OF THE INVENTION

The present invention relates generally to the control of a work performing machine in response to the occurence of a predetermined condition with respect to a material workpiece supplied thereto.

More specifically, in the garment and associated industries, it has been generally known to utilize a sewing machine with a conventional attachment for producing a spaghetti-like tube from a bias binding strip, these tubes having external stitching which is turned inwardly by the attachment to make the stitching invisible. The attachment may be operated to produce the tube with or without an internal core. Presently, provision is made for stopping the sewing operation only in the event that the supplied bias binding strip runs out, and for this purpose switching contacts under control of the supplied binding strip are arranged to operate in a control circuit and stop the sewing machine operation, when the binding material runs out. Conventional known arrangements that are utilized to stop the machine operation only in the event that the supplied binding strip runs out, have in practice been found to be inadequate as to their scope of protection. The conventional arrangements are not arranged to stop the machine, for example, when the end seam connections between the contiguous ends of the binding strip sections are too thick, or when the binding strip may become twisted or knotted.

The present invention therefore seeks to provide a unique control switch which will extend the scope of protection and stop the machine operation in those above enumerated situations in which the presently known controls are ineffective. For such purpose, a rocker type switch structure in the nature of a single-pole double-throw switch is utilized, this switch being provided with a hinged rocker arm which is normally biased in one direction to a throw position that operatively closes a first set of contacts, and upon hinged removement of the rocker arm in an opposite direction will operate to open the first set of contacts and close a second set of contacts. The first and second sets of contacts are electrically connected in parallel in a control circuit in such a manner that the closure of either set of contacts will function to stop the machine operation. Normally, the biasing strip-material is fed to the machine attachment between the first set of contacts and serves to maintain these contacts in an open position. The second set of contacts are adjustable so that, during such normal operation, the second set of contacts will also occupy an open position. As thus arranged, if the supplied binding strip should break or run out the first set of contacts will close and stop the machine operation. If the seams connecting the ends of the binding strip sections are too thick, or if the binding strip should become twisted or knotted, then the second set of contacts will close and stop the machine operation.

SUMMARY OF THE INVENTION

The present invention is more specifically concerned with an improved control switch for stopping the operation of a work performing machine in response to the occurance of any one of a plurality of predetermined undesired conditions with respect to a workpiece fed thereto.

It is one object of the herein described invention to provide an improved work performing machine control which includes a unique switch structure having contacts operable to stop the machine operation in response to the presence of a predetermined undesirable condition in a workpiece being supplied to the machine.

A further object is to provide a sewing machine control in which the presence of a predetermined condition in a workpiece being fed to an associated machine attachment will operate to stop the machine operation.

Another object is to provide a control according to the previous object in which the workpiece is a fabric binding strip material comprised of sections connected in end-to-end relation by end seams, and in which the control is operative to stop the machine when (1) an end seam is too thick, (2) the binding strip becomes knotted or twisted, and (3) the supplied binding strip material breaks or runs out.

A still further object is to provide a stop control for a sewing machine in which a binding strip is fed to a forming attachment, and in which the control comprises a switch structure having one set of contacts biased towards a closed position, and being normally separated by feeding the binding strip therebetween, and a second set of normally opened contacts that are adapted to close in response to a predetermined further separation of the first set of contacts beyond the normal open position resulting from the binding strip being fed therebetween.

Further objects of the invention will be brought out in the following part of the specification, wherein detailed description is for the purpose of fully disclosing the invention without placing limitations thereon.

BRIEF DESCRIPTION OF THE DRAWINGS

Referring to the accompanying drawings which are for illustrative purposes only:

FIG. 1 is a view diagramatically illustrating a conventional sewing machine and an associated attachment, in perspective, for forming spaghetti-like tubes from a bias binding strip fed thereto, together with the control circuitry according to the present invention;

FIG. 2 is an enlarged fragmentary longitudinal transverse sectional view, taken substantially on line 2—2 of FIG. 1, showing the operative function of the spaghetti forming attachment;

FIG. 3 is an enlarged transverse section, taken substantially on line 3—3 of FIG. 2;

FIG. 4 is a transverse sectional view, taken substantially on line 4—4 of FIG. 2;

DESCRIPTION OF A PREFERRED EMBODIMENT

Figure 5:
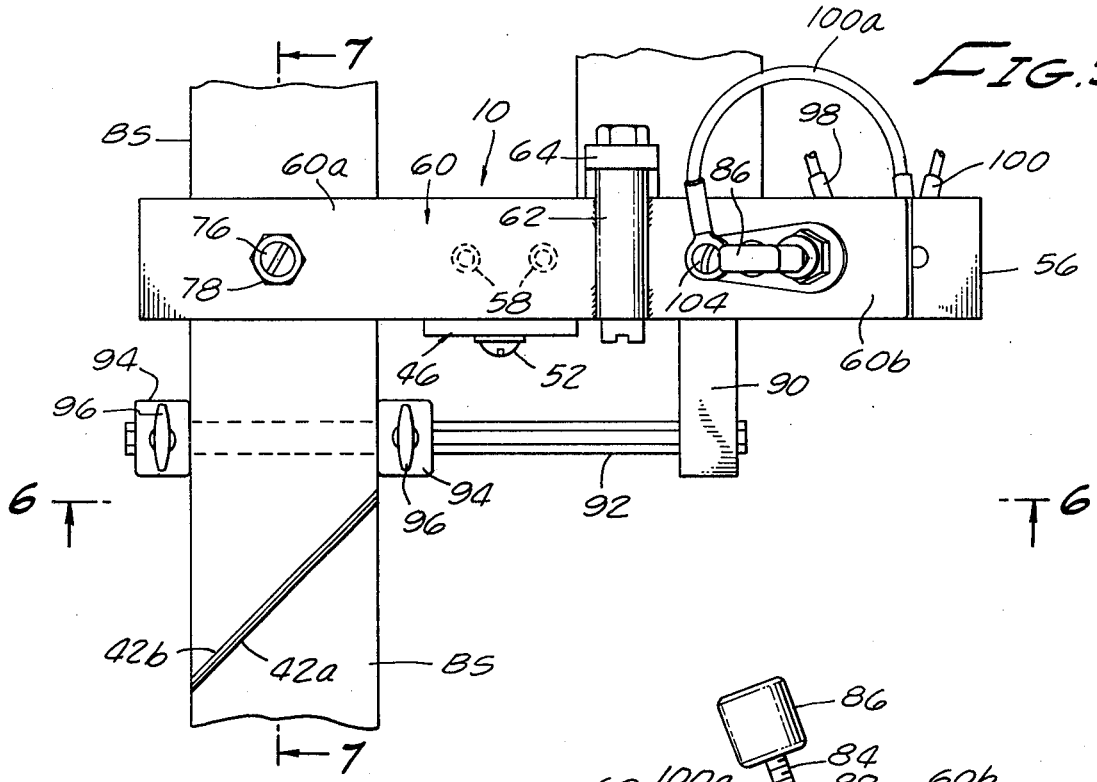
FIG. 5 is enlarged plan view of a feed control switch embodying the features and construction according to the present invention.

Referring more specifically to the drawings, the stop control mechanism according to the present invention is illustrated in FIG. 1 as comprising a unique control switch structure, as generally indicated at 10, for sensing certain characteristics of a binding strip B which is fed to a conventional sewing machine attachment A for forming the binding strip into a spaghetti tube, without visible stitching, and with or without a cord filler. The stitching process is performed by a conventional sewing machine SM which is driven in a conventional manner from an electric driving motor M through a conventional clutch C arranged for operator control in a manner which will subsequently be described more fully.

The control switch structure 10 is utilized to sense predetermined characteristics of the binding strip, and is arranged in a control circuit for terminating the sewing machine operation, either through manipulation of the clutch C or in the case of some installations by deenergizing the driving motor M.

Applicant's control switch 10 is readily adaptable to various types of sewing machine drive control, and for simplicity has been illustrated in the instant case as being operatively connected with a clutch control mechanism having a control lever 12 which is normally biased as by a tension spring 14 into a clutch disengaged position as shown in full lines. When it is desired to operate the sewing machine, the control lever 12 would be moved by the operator into a clutch engaged driving position, as shown in phantom lines, and in which position the lever would be mechanically latched by means of a pivoted latch member 16 which is biased towards a latching position by means an associated tension spring 18. A connected solenoid having an actuating coil 20 is energizable to move the latch member to an unlatched position. The energizing coil 20 is energized from a step-down transformer 22 having its primary side connected with an energizing circuit 24 of the driving motor M, and its secondary winding connected through the control switch structure 10 of the present invention in such a manner that under certain predetermined conditions of operation, the actuating coil 20 will be energized and operate to move the latch member 16 to an unlatched position and thus enable movement of the control level 12 to a clutch open position and thereby interrupt the operation of the sewing machine SM.

The attachment A is of well known conventional construction and embodies an attaching bracket 26 connected at one end to a forming member 28 which is conformed to provide a longitudinally tapered guide channel 30 adapted to treatingly receive the binding strip BS therein and at its outlet end to deliver a reduced arcuately formed strip over the projecting end of an axially extending tube member 32 with outwardly projecting adjacent edge margins 34*a* and 34*b* of the binding material in overlying relationship. These edge margins are secured together by machine stitching, as indicated by the numeral 36, to form a seam on the spaghetti-like fabric tube 38. As thus formed, the tube has an external longitudinally extending visible seam. In order to conceal the seam and make it invisible, the tube 38 is trained over the adjacent end of the tube member 32 and discharged from its opposite end as a final product. When it is desired to have a core within the finished tube 38, the core forming material, as indicated at 40, may be fed into the inner end of the tube member 32 as the seam is being changed to the inside of the spaghetti-like tube.

Figure 7:
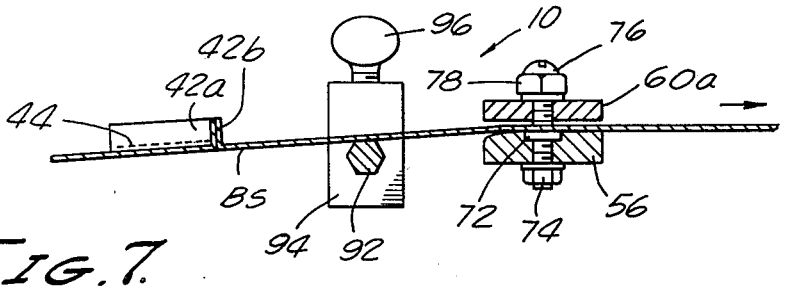
FIG. 7 is a sectional view, taken substantially on line 7—7 of FIG. 5, and showing the cooperative relationship between the workpiece, which is being fed to the attachment, and the switch control contacts.

As best shown in FIGS. 1, 5 and 7, the binding strip BS is fabricated from elongate bias fabric sections which are secured together at contiguous ends in end-to-end relation by end connecting seams in which similarly turned end margins, as indicated by numerals 42*a* and 42*b*, are connected by stitching 44.

Heretofore, in the utilization of an attachment such as the described attachment A for producing spaghetti-like tubing, it has been the practice to make provision only for interrupting the machine operation in the event that the feeding of the binding strip material BS to the attachment is interrupted, for example, by breakage of the binding strip or in the event that the strip runs out. This protection is inadequate, and in the present invention, an improved control is provided to assure that the machine operation will be interrupted in the event that: (1) a binding strip connecting end seam is too thick, and (2) the binding strip becomes knotted or twisted.

Figure 6:
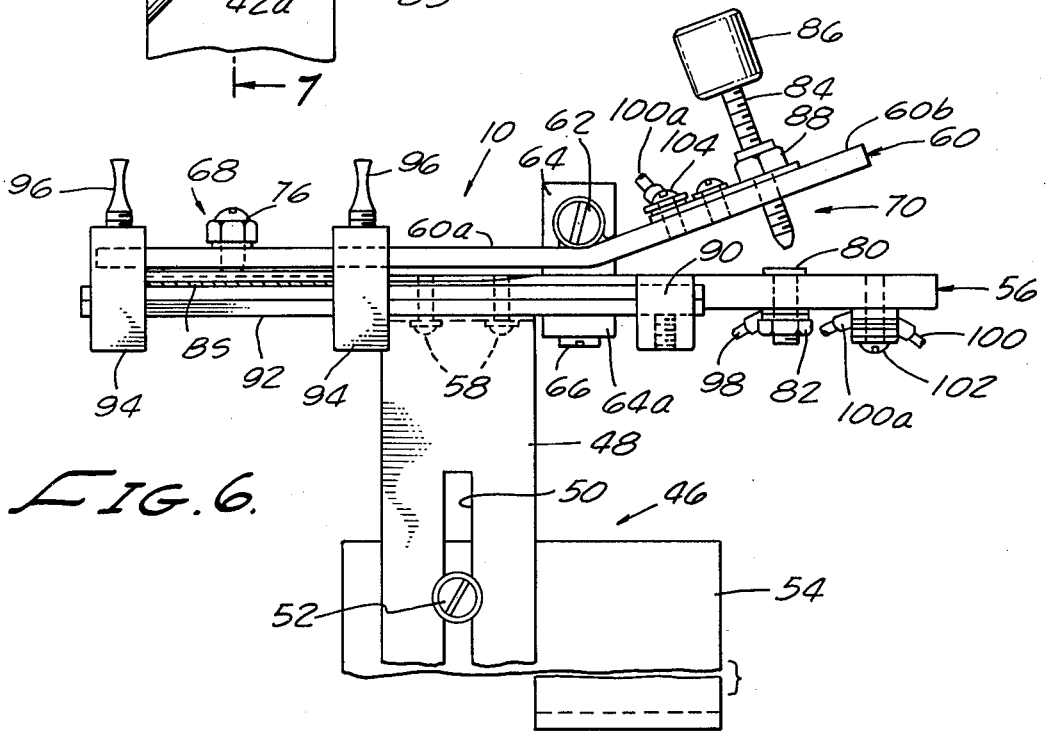
FIG. 6 is an elevational view of the same, partly in section, as viewed substantially along lines 6—6 of FIG. 5.

The foregoing improved protective features are accomplished in the present invention by the improved switch structure 10 which will now be described in detail. As best shown in FIGS. 5, 6 and 7, the switch structure 10 is supported upon an attaching bracket 46 which permits it to be operatively connected in a desired position on the sewing machine SM and for sensing the binding strip BS as it is fed to the attachment A. The bracket 46 includes an upright member 48 which is adjustably connected by a slot 50 and screw 52 connection to a support 54.

The switching structure essentially comprises an elongate fixed switch member 56 of a conducting material such as aluminum, which is fixably secured to an upper-end portion of the upright member 48 as by screws 58. A movable switch member 60 of a suitable material such as aluminum is operatively associated with the fixed switch member 56 and takes the form of an elongate rocker arm which is swingably supported upon an insulated pivot 62 intermediate its ends by means of a supporting bracket 64 which has a lower end portion 64*a* underlying the fixed switch member 56 and secured thereto as by means of screws 66. As shown in FIG. 6, it will observed that the switch member 60 is fabricated to provide a relatively long portion 60*a* on one side of the hinge pivot and a relatively short portion 60*b* on the opposite side of the pivot, these portions being in upwardly diverging angular relation. It will be readily apparent that with this arrangement, the movable switch member 60 will be normally biased by gravity in a counter clockwise direction as viewed in FIG. 6 to a normal position in which the portion 60*a* is in substantially parallel relation to the adjacent underlying switch member 56, while the portion 60*b* is in an angularly extending position with respect to the underlying portion of the fixed switch member 56.

The switch members 56 and 60 are provided with a first set of contacts 68 which are positioned on one side of the insulated pivot 62 and a second set of contacts 70 which are positioned on the other side of the insulated pivot 62. The first set of contacts, as best shown in FIG. 7, comprises a headed contact 72 having a threaded stem which is engaged by a securing nut 74. This contact has conducting engagement with the fixed switch member 56 on which it is mounted. The other contact of the first set of contacts comprises a threaded screw member 76 having a threaded shank in adjustable threaded engagement with the portion 60*a* of the movable switch member 60. This contact is in conducting engagement with the switch member and may be locked in adjusted position by means of a locking nut 78. The second set of contacts 70, as best shown in FIG. 6 comprises a headed contact 80 having a threaded stem which is engaged by a retaining nut 82. This contact has conducting engagement with the fixed switch member 56 on which it is mounted. The other contact of the second set of contacts comprises an elongate screw having a threaded shank 84 which extends through the end portion 60*b* of the movable switch member 60 for adjustable cooperative relationship with the contact 80. The threaded shank has at its upper end a finger engageable head portion 86 to facilitate the adjustment of this contact, and further provides a lock nut 88 to facilitate securing this contact in its adjusted position.

As shown in FIG. 5, the first set of contacts is utilized for sensing the binding strip S which is fed therebetween in route to the forming attachment A. In this connection it has been found desirable to provide means for guiding the binding strip in its movement between the first set of contacts, and for this purpose a bracket 90 secured to the fixed switch member 56 is secured to one end of a rod member 92 in such a manner as to provide a slide rail which extends generally in parallel spaced relation to the fixed switch member 56 to serve as a support for a pair of guide blocks 94. Each of these guide blocks is slidable along the rod member 92 and mount in each case a thumb screw 96 which enables the guide blocks to be mounted in appropriate guiding relationship for the feeding of the binding strip BS.

As shown in FIG. 1, control circuit conductors 98 and 100 are electrically connected to the respective switch member 56 and 60, and as thus connected, the first set of contacts 68 and the second set of contacts 70 are electrically in parallel relation in the circuit. Normally, contacts 68 are maintained in open position by the passage of the binding strip therebetween. During this normal operation, the second set of contacts 70 are in open position. In the event, that there is not binding strip between the contacts 68, these contacts will close and complete the control circuit. However, during normal operation, the contacts 70 will be in open position, but if any of the connecting end seams of the binding strip sections are too thick or if the binding strip should become knotted, this will result in a further separation of the first set of contacts 68 sufficiently to close the contacts 70 of the second set of contacts and thus activate the control circuit. For convenience, the circuit conductor 100 may be carried to a terminal post 102 which is insulatingly mounted on the fixed switch member 56. In this case, a jumper connection 100*a* may be provided between the binding post 102 and a terminal connection 104 on the switch member 60 and having current conducting engagement therewith.

It is believed that the operation of the stop control mechanism of the present invention will be clearly apparent from the foregoing description, that outlined objects of the invention will be obtained, and the unique and cooperative relationship of applicant's unique switching structure will provide salient features and desirable operational advantages over the known prior art arrangements.

Various modifications may suggest themselves to those skilled in the art without departing from the spirit of the disclosed invention, and, hence, it is not wished to be restricted to the specific forms shown or uses mentioned except to the extent indicated in the appended claims.

I claim:

1. As an article of manufacture, a control switch for interrupting the operation of a power driven sewing machine in which a fabric bias binding strip-material is fed to a work performing attachment operatively associated with said machine, and wherein the operation of said control switch is responsive to the presence of one or more predetermined abnormal conditions of said binding strip-material, said switch comprising:

a supporting bracket frame structure;

an elongate fixed switch member mounted on said bracket;

an elongate rocker arm switch member hingedly mounted between its ends on said bracket, and axially extending generally along the fixed switch member;

a first set of operatively associated contacts respectively mounted on said switch members on one side of the hinge mounting;

a second set of operatively associated contacts mounted on said switch members on the other side of the hinge mounting; and said sets of contacts being so arranged that when the contacts of one of said sets is closed, the contacts of the other set will be open.

2. An article of manufacture according to claim 1, in which:

said rocker arm is normally biased for hinged movement in a direction to close said first set of contacts.

3. An article of manufacture according to claim 1, in which:

the rocker arm length on the side of said first set of contacts is greater than the length on the side of said second set of contacts, whereby the rocker arm will be gravity biased for hinged movement in a direction to close said first set of contacts.

4. An article of manufacture according to claim 3, in which:

the rocker arm lengths on the opposite sides of said hinge mounting longitudinally extend at an angle to each other.

5. An article of manufacture according to claim 1, in which:

the contact of at least one of said sets of contacts that is carried by said rocker arm is adjustable to vary its operative open spacing with respect to its associated fixed contact.

6. An article of manufacture according to claim 1, which includes:

adjustable means for guidingly varying the axis of the feed path of the binding strip-material between said first set of contacts.

7. An article of manufacture according to claim 6, in which:

the adjustable guide means comprises:

a fixed elongate rod member supportingly connected with said bracket and extending in spaced relation along one side of said fixed switch member;

guide blocks slidably movable longitudinally along said rod; and a thumb screw on each of said blocks for releasably securing it in an adjusted position on said rod.

* * * * *